US009151467B2

(12) United States Patent
Ansems et al.

(10) Patent No.: US 9,151,467 B2
(45) Date of Patent: Oct. 6, 2015

(54) SINGLE CHAMBER LIGHTING DEVICE

(75) Inventors: Johannes Petrus Maria Ansems, Hulsel (NL); Vincent Stefan David Gielen, Eindhoven (NL); Marcus Joannes Van Den Bosch, Shanghai (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 334 days.

(21) Appl. No.: 13/810,924

(22) PCT Filed: Jul. 14, 2011

(86) PCT No.: PCT/IB2011/053147

§ 371 (c)(1),
(2), (4) Date: Jan. 18, 2013

(87) PCT Pub. No.: WO2012/011030

PCT Pub. Date: Jan. 26, 2012

(65) Prior Publication Data

US 2013/0120965 A1 May 16, 2013

(30) Foreign Application Priority Data

Jul. 21, 2010 (EP) ..... 10170227

(51) Int. Cl.

| | |
|---|---|
| ***F21V 7/10*** | (2006.01) |
| ***F21K 99/00*** | (2010.01) |
| *F21Y 101/02* | (2006.01) |

(52) U.S. Cl.

CPC ... *F21V 7/10* (2013.01); *F21K 9/00* (2013.01); *F21K 9/13* (2013.01); *F21K 9/135* (2013.01); *F21K 9/50* (2013.01); *F21Y 2101/02* (2013.01)

(58) Field of Classification Search

CPC ..... F21V 7/10; F21K 9/00; F21K 9/135
USPC ..... 362/84, 235, 245, 246, 249.02
See application file for complete search history.

(56) References Cited

U.S. PATENT DOCUMENTS

| | | | | |
|---|---|---|---|---|
| 6,218,785 | B1 | 4/2001 | Incerti | |
| 6,988,815 | B1 * | 1/2006 | Rizkin et al. | 362/245 |

(Continued)

FOREIGN PATENT DOCUMENTS

| | | | |
|---|---|---|---|
| CN | 101275731 | Y | 10/2008 |
| CN | 201373332 | Y | 12/2009 |

(Continued)

*Primary Examiner* — David V Bruce
(74) *Attorney, Agent, or Firm* — Yuliya Mathis

(57) ABSTRACT

A lighting device (1) for providing a homogeneous luminous intensity distribution in relation to an optical axis of the lighting device (1), the lighting device (1) comprising: at least one light source (7); a housing (3) arranged to enclose the at least one light source (7), the housing (3) comprising an at least partly transparent housing portion being arranged in parallel to the optical axis of the lighting device (1); and a reflector (4) arranged inside the housing (3), the housing (3) and the reflector (4) together defining a single light mixing chamber (6), wherein the reflector (4) is arranged to reflect light from the at least one light source (7) away from the optical axis of the lighting device (1) towards the at least partly transparent housing portion.

13 Claims, 2 Drawing Sheets

(56) References Cited

U.S. PATENT DOCUMENTS

| | | | | |
|---|---|---|---|---|
| 7,229,196 | B2 | 6/2007 | Hulse | |
| 7,316,487 | B2 | 1/2008 | Hirata et al. | |
| 7,600,882 | B1 | 10/2009 | Morejon et al. | |
| 7,600,897 | B2 * | 10/2009 | Tsai | 362/294 |
| 2006/0007709 | A1 | 1/2006 | Yuen | |
| 2008/0310158 | A1 | 12/2008 | Harbers et al. | |
| 2009/0303731 | A1 | 12/2009 | Chang | |
| 2011/0170294 | A1 * | 7/2011 | Mier-Langner et al. | 362/294 |
| 2014/0204581 | A1 * | 7/2014 | De Jong et al. | 362/235 |

FOREIGN PATENT DOCUMENTS

| | | | |
|---|---|---|---|
| JP | 2005044766 | A | 2/2005 |
| JP | 200932466 | A | 2/2009 |
| JP | 2010015798 | A | 1/2010 |
| WO | 2006135595 | A2 | 12/2006 |
| WO | 2008157080 | A2 | 12/2008 |
| WO | 2010131166 | A1 | 11/2010 |

* cited by examiner

SINGLE CHAMBER LIGHTING DEVICE

TECHNICAL FIELD

The present invention relates to a lighting device for providing a homogeneous luminous intensity distribution in relation to an optical axis of said lighting device.

BACKGROUND OF THE INVENTION

Conventional lighting devices such as incandescent light bulbs are rather inefficient as lighting devices due to the amount of heat being released from the lamp. A majority of the electricity is transferred into heat. In some bulbs as much as 95-96% of the electricity is transferred into heat and the remaining 4-5% into light. In addition the incandescent lamp suffers from a relatively short life time of about a thousand hours.

Solutions using semi conductor based lighting devices have gain increased attention due to their energy efficient characteristic properties in which approximately 50% of the electricity is transferred into heat and approximately 50% into light. The semiconductor based light sources are also combined with a relatively long life time of tens of thousands of hours.

Whereas the incandescent light bulb emits light in all directions and achieves a homogeneous light distribution pattern, the semiconductor based lighting device has a directed light, which results in a non-uniform light distribution pattern.

One solution to the non-uniform light distribution pattern is disclosed in U.S. Pat. No. 7,229,196, which describes a lighting device having a light transmitting member in the shape of a toroid having a top and a bottom reflector. The light distribution pattern is improved by the light transmitting member, however the overall light distribution pattern does not resemble the light from an incandescent bulb.

SUMMARY OF THE INVENTION

In view of the above, a general object of the present invention is to provide an improved lighting device, in particular enabling an improved luminous intensity distribution.

According to a first aspect of the invention, there is provided a lighting device for providing a luminous intensity distribution in relation to an optical axis of the lighting device, the lighting device comprising at least one light source; a housing arranged to enclose the at least one light source, the housing comprising an at least partly transparent housing portion being arranged in parallel to the optical axis of the lighting device; and a reflector arranged inside the housing, the housing and the reflector together defining a single light mixing chamber, wherein the reflector is arranged to reflect light from the at least one light source away from the optical axis of the lighting device towards the at least partly transparent housing portion.

The direct light emitted from the light source is reflected away from the optical axis towards the housing in order to achieve an omni-directional spreading of the light, which in turn will resemble the light distribution of an incandescent light bulb.

The present invention is based on having a light mixing chamber defined by the housing and the reflector that together provides a luminous intensity distribution. If the shape of the housing is changed, it may be possible to change the shape of the reflector. The luminous intensity distribution could then be maintained whereas the physical shape of the lamp is changed.

The result is an improved lighting device, which provides a more luminous intensity distribution compared to prior art devices. For example the lighting device according to various embodiments of the invention may have various physical shapes and still maintain a luminous intensity distribution.

According to various embodiments of the invention the light mixing chamber may be rotationally symmetric around the optical axis of the lighting device.

Having a rotationally symmetric light mixing chamber may allow for a better and more luminous intensity distribution.

According to another embodiment of the present invention, the light mixing chamber may be formed in the shape of a toroid.

According to various embodiments of the invention, the light mixing chamber defined by the housing and the reflector is hollow.

Furthermore, the at least one light-source may be positioned within said light mixing chamber.

According to various embodiments the at least one light-source may be arranged to emit light in a principal direction of emission, which direction is substantially parallel to the optical axis of the lighting device.

The at least one light source may also be a plurality of light-sources. By using a plurality of light sources it is possible to tune the luminosity distribution even further compared to a single light source.

Furthermore, the light sources may be mounted on a single substrate. Using a single substrate reduces the cost of producing multiple substrates for each or multiple light source. The single substrate may comprise a printed circuit board.

According to various embodiments of the invention the optical axis of the lighting device may also be an axis of rotational symmetry for said lighting device.

According to various embodiments of the invention, the reflector may be partly transparent.

Using a partly transparent reflector allows light to be transmitted through the reflector into an area where light normally is blocked. A partly transparent reflector could be suitable for lighting devices having a reflector with a relatively large surface that may block too much of the light during operation of the lighting device.

According to another embodiment of the invention, the housing may be at least partly reflective.

According to yet another embodiment of the invention, the housing may comprise at least a portion being diffusely transparent or translucent.

In some applications it may be desired to have a housing being capable of reflecting light in order to achieve an internal reflection to evenly spread the light over the transparent portion of the housing. Having a diffusely transparent or translucent housing results in a lighting device that reduces glaring light.

In another embodiment, the housing may comprise a wavelength converting member, such as phosphor.

Using phosphor on the housing makes the light from semiconductor based light sources to feel warmer for a person observing the light.

Advantageously, the at least one light source may comprise at least one light emitting diode (LED).

Furthermore, the at least one light emitting diode may be a group of light emitting diodes.

In another embodiment the reflector may be connected to the single substrate and wherein the reflector may be used as a cooling element for the substrate.

An advantage with this setup is that the reflector can serve as both reflector and as a cooling element, in which heat is transferred away from the single substrate.

According to various embodiments of the present invention, the reflector comprises a portion facing away from the optical axis.

BRIEF DESCRIPTION OF THE DRAWINGS

These and other aspects of the present invention will now be described in more detail, with reference to the appended drawings showing an exemplary embodiment of the invention, wherein.

DETAILED DESCRIPTION OF AN EMBODIMENT OF THE INVENTION

In the following description, the present invention is described with reference to a lighting device comprising a light source, a housing and a reflector.

Figure 1:
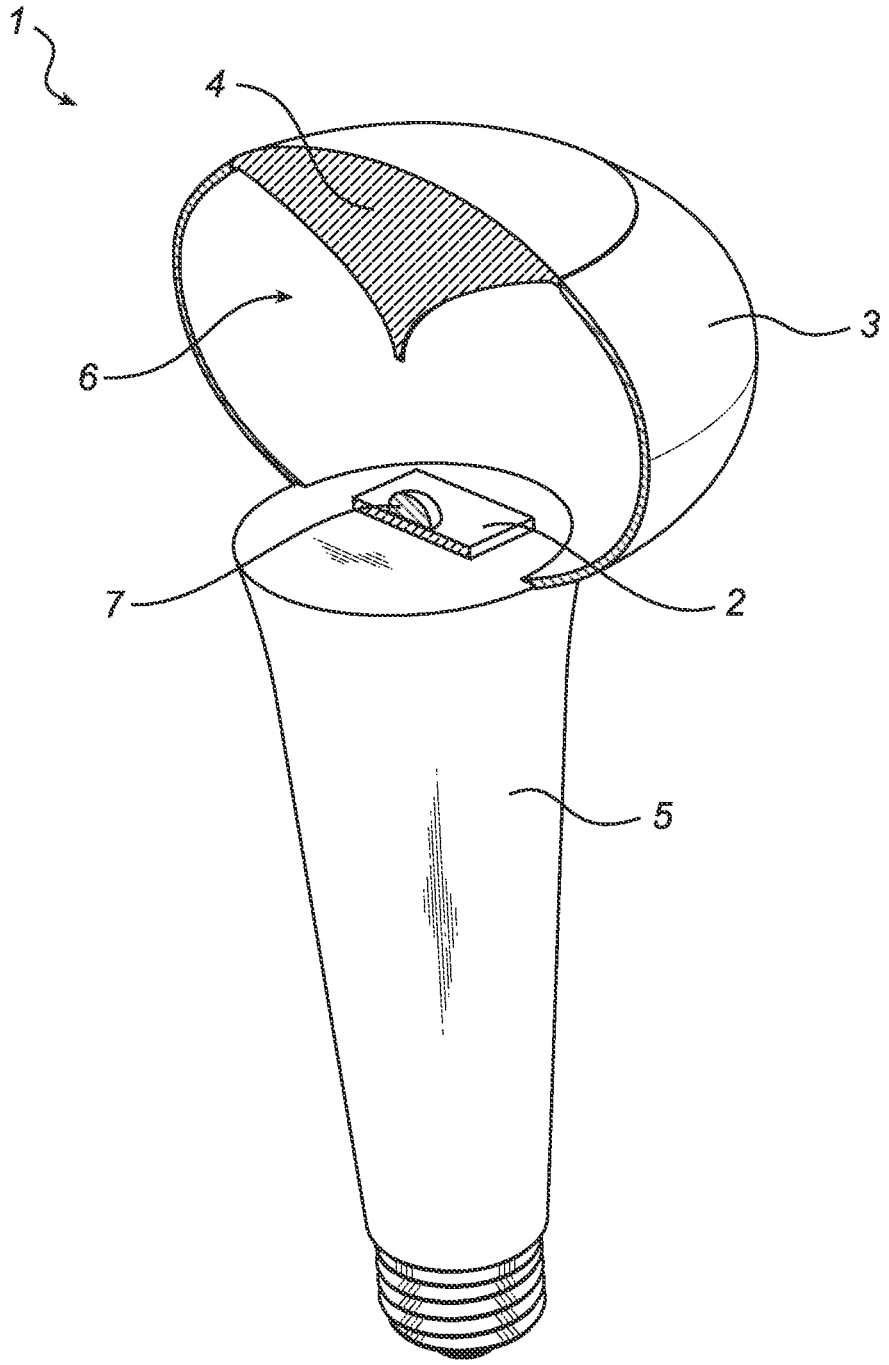
FIG. 1 shows a perspective view of a lighting device according to one embodiment of the invention.

FIG. 1 shows a perspective view partly broken away of an embodiment of the lighting device 1 according to the present invention. The lighting device 1 comprises a base 5, a light source 7, a housing 3, a printed circuit board 2, and a reflector 4.

The light source 7 used in the lighting 1 device may for example be a light emitting diode (LED). Other types of semiconductor based or solid state based light sources may also be used as light sources 7. The light source 7 is arranged on a printed circuit board 2, and the printed circuit board 2 is arranged on the base 5. One or several LEDs may share the same printed circuit board 2.

The housing 3 is arranged to enclose the light source 7 and could be made at least partly transparent. Having portions at the housing 3 with different transparency makes it possible to tailor the shape of the emitted luminous distribution from the lighting device 1. The housing 3 is also in contact with the base 5 as illustrated in FIG. 1. Furthermore, the housing 3 may be combined with a phosphorous layer to set a desired color or color temperature of the emitted light from the lighting device 1. The use of phosphor is particularly suitable for LED based light sources 1. If for example white LEDs are used a diffuser may be used instead of phosphorus material.

A reflector 4 is positioned in contact with the housing 3 and arranged to reflect light away from an optical axis of the lighting device 1. The light is emitted from the LED 7 towards the reflector 4 and then reflected towards the housing 3 portion. The light will then exit through the housing 3 at portions being at least partly transparent. The reflector 4 is shaped such that the reflector 4 together with the housing 3 and the base 5 defines a light mixing chamber 6. According to the embodiment shown in FIG. 1 the reflector 4 is positioned above the LED 7 and in contact with the housing 3 without being in contact with the LED 7, the printed circuit board 2 or the base 5.

In FIG. 1 the light mixing chamber 6 assumes a toroidal shape although other shapes are possible as long as the above mentioned product is held constant. It may for some embodiments of the invention be possible to design the housing 3 in a way such that a reflector 4 is not required.

The light emitted from the LED 7 usually assumes the shape of a torch around an optical axis of the lighting device 1. The emitted light, however, does not resemble the light from an incandescent bulb in which the light distribution is more omnidirectional compared to the emitted light from the LED.

A reflector 4 is inserted in the housing 3 to reflect the light away from the optical axis. The emitted light is directed towards the housing 3 and emitted through the housing 3. The effect is a light distribution being more omnidirectional than without the reflector 4.

The reflector 4 may be partly transparent to further tailor the shape of the light distribution.

The term omnidirectional should be understood as a uniform radiation in any plane. This means that the light emitted from the lighting device 1 will try and emit light in all directions to reach an omnidirectional light distribution. It should be realized that in most practical applications of lighting devices according to several embodiments of the invention it may not be possible to achieve a fully omnidirectional distribution since the base 5 of the lighting device 1 may block the light.

Figure 2:
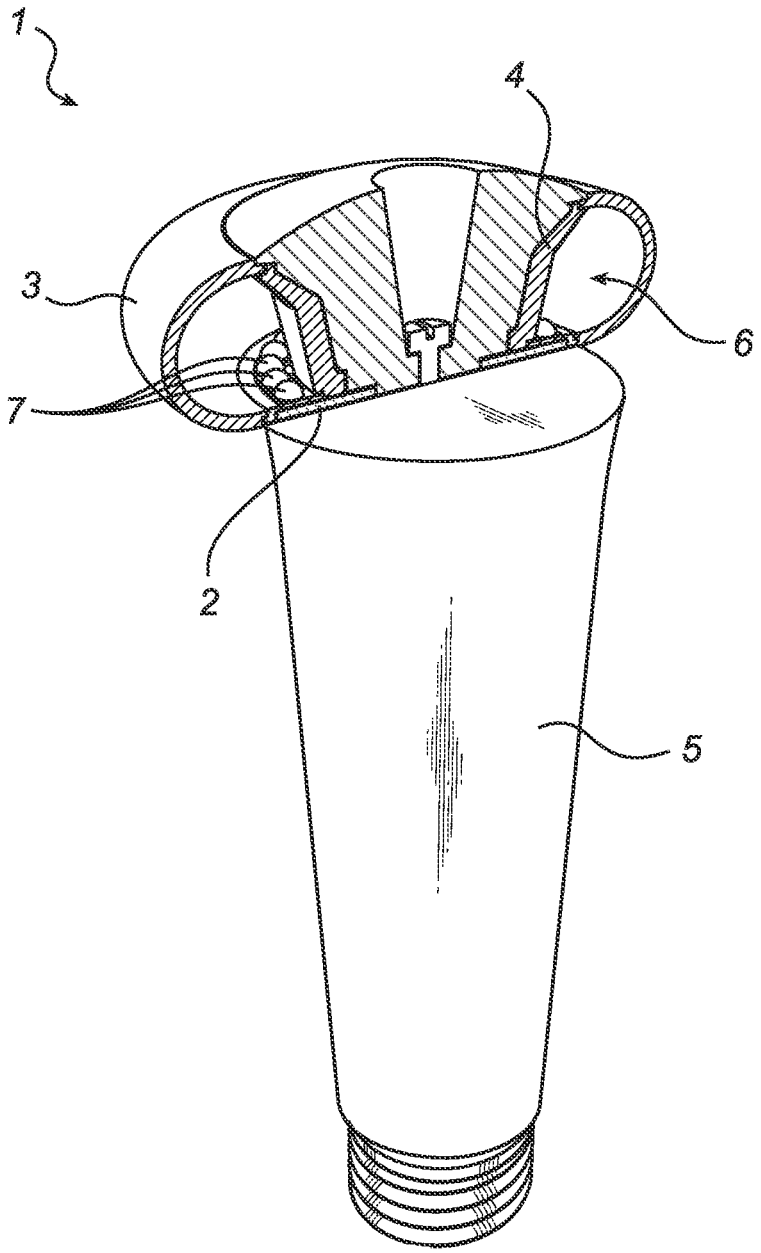
FIG. 2 shows a perspective view of a lighting device according to a second embodiment of the invention.

FIG. 2 shows a perspective view partly broken away of another embodiment of the lighting device 1 according to the present invention. The lighting device 1 is similar to the embodiment shown in FIG. 1, but with different light source 7 and reflector 4.

In the embodiment shown in FIG. 2, the light source 7 is made up by a plurality of light sources 7. The light sources 7 may be LEDs or other semiconductor based or solid state based light sources.

The plurality of LEDs 7 are arranged circumferentially around an optical axis and no LEDs are present in the centre of the optical axis. Furthermore, the plurality of LEDs 7 are mounted on a single printed circuit board 2. The printed circuit board 2 has a hole in the center.

The reflector 4 is in this embodiment mounted such that the reflector 4 is in contact with the printed circuit board 2 on an inner circle of the plurality of LEDs 7. In this way the reflector 4 extends down to the printed circuit board 2 and is surrounded by LEDs 7 circumferentially around the reflector 4. The reflector 4 may act as a cooling element for the printed circuit board 2 while functioning as a reflector 4 for the plurality of LEDs 7. The heat generated in the printed circuit board 2 is transferred away and out from the lighting device 1 with the help of the reflector 4.

Additionally, variations to the disclosed embodiments can be understood and effected by the skilled person in practicing the claimed invention, from a study of the drawings, the disclosure, and the appended claims. For example, the housing may assume other shapes besides a toroidal shape.

The invention claimed is:

1. A lighting device for providing a homogeneous luminous intensity distribution in relation to an optical axis of said lighting device, said lighting device comprising:

at least one light source, comprising a plurality of LEDs;

a housing arranged to enclose said at least one light source, said housing comprising an at least partly transparent housing portion being arranged in parallel to said optical axis of the lighting device, said housing being at least partly reflective; and a reflector arranged inside said housing, said housing and said reflector being part of a single light mixing chamber, wherein said reflector is arranged to reflect light from said at least one light source away from said optical axis of the lighting device towards the at least partly transparent housing portion.

2. The lighting device according to claim 1, wherein said light mixing chamber is rotationally symmetric around said optical axis of the lighting device.

3. The lighting device according to claim 1, wherein said light mixing chamber is formed in the shape of a toroid.

4. The lighting device according to claim 1, wherein the at least one light-source is arranged to emit light in a principal direction of emission, which direction is substantially parallel to the optical axis of the lighting device.

5. The lighting device according to claim 1, wherein said at least one light source is a plurality of light-sources.

6. The lighting device according to claim 5, wherein said light sources are mounted on a single substrate.

7. The lighting device according to claim 5, wherein the optical axis of the lighting device is also an axis of rotational symmetry for said lighting device.

8. The lighting device according to claim 5, wherein said reflector is partly transparent.

9. The lighting device according to claim 5, wherein said housing comprises at least a portion being diffusely transparent or translucent.

10. The lighting device according to claim 5, wherein said housing comprises a wavelength converting member.

11. The lighting device according to claim 5, wherein said at least one light emitting diode is a group of light emitting diodes.

12. The lighting device according to claim 5, wherein said reflector is connected to said single substrate and wherein said reflector is used as a cooling element for the substrate.

13. The lighting device according to claim 5, wherein said reflector comprises a portion facing away from said optical axis.

* * * * *